US007762191B2

(12) United States Patent
Rastegar et al.

(10) Patent No.: US 7,762,191 B2
(45) Date of Patent: Jul. 27, 2010

(54) ENERGY HARVESTING POWER SOURCES FOR ACCIDENTAL DROP DETECTION AND DIFFERENTIATION FROM FIRING

(75) Inventors: Jahangir S. Rastegar, Stony Brook, NY (US); Carlos M. Pereira, Tannersville, PA (US); Richard Dratler, Montville, NJ (US)

(73) Assignee: Omnitek Partners, LLC, Bayshore, NY (US)

( * ) Notice: Subject to any disclaimer, the term of this patent is extended or adjusted under 35 U.S.C. 154(b) by 657 days.

(21) Appl. No.: 11/654,090

(22) Filed: Jan. 17, 2007

(65) Prior Publication Data

US 2010/0155472 A1 Jun. 24, 2010

Related U.S. Application Data

(60) Provisional application No. 60/759,606, filed on Jan. 17, 2006.

(51) Int. Cl.
*F42C 11/02* (2006.01)

(52) U.S. Cl. ..... 102/210; 102/216; 102/207; 89/27.11; 89/28.05; 89/28.1; 89/6; 89/6.5

(58) Field of Classification Search ..... 102/210, 102/216, 207; 89/27.11, 28.05, 28.1, 6, 6.5
See application file for complete search history.

(56) References Cited

U.S. PATENT DOCUMENTS 3,106,161 A * 10/1963 Hermann et al. ..... 102/210
3,397,329 A * 8/1968 Riedel ..... 310/315
3,540,377 A * 11/1970 Bednar et al. ..... 102/210
3,624,451 A * 11/1971 Gauld ..... 361/251
3,653,324 A * 4/1972 Furlani et al. ..... 102/215
3,670,653 A * 6/1972 Lunt et al. ..... 102/210
3,718,092 A * 2/1973 Pitman et al. ..... 102/215
3,756,157 A * 9/1973 England et al. ..... 102/210
3,785,292 A * 1/1974 Bendler et al. ..... 102/210
3,850,102 A * 11/1974 Morrow ..... 102/210
3,941,058 A * 3/1976 Gawlick et al. ..... 102/210
3,952,660 A * 4/1976 Davis et al. ..... 102/207
3,967,555 A * 7/1976 Gawlick et al. ..... 102/210
4,141,298 A * 2/1979 Weidner ..... 102/210
4,176,608 A * 12/1979 Ambrosini et al. ..... 102/216
4,215,633 A * 8/1980 Anderson et al. ..... 102/210
5,033,382 A * 7/1991 Webb ..... 102/235
5,157,220 A * 10/1992 Schaffhauser et al. ..... 102/210
5,166,469 A * 11/1992 Kerdraon et al. ..... 102/210
5,269,223 A * 12/1993 Mattsson et al. ..... 102/210
5,271,329 A * 12/1993 Blin et al. ..... 102/216
5,485,788 A * 1/1996 Corney ..... 102/472
5,533,454 A * 7/1996 Ellis et al. ..... 102/202.1
5,929,368 A * 7/1999 Ewick et al. ..... 102/215
6,858,970 B2 * 2/2005 Malkin et al. ..... 310/322
7,132,757 B2 * 11/2006 Steigerwald et al. ..... 290/1 R
7,312,557 B2 * 12/2007 Rastegar et al. ..... 310/339
7,506,586 B1 * 3/2009 Pereira et al. ..... 102/207
2003/0076261 A1 * 4/2003 Ryken et al. ..... 343/700 MS (Continued)

*Primary Examiner*—Troy Chambers
*Assistant Examiner*—Samir Abdosh

(57) ABSTRACT

A method is provided for differentiating a non-firing event of a munition from a firing event. The method including: providing the munition with a power supply having a piezoelectric material for generating power from a vibration induced by the munition; monitoring an output from the power supply; calculating an impact pulse from the output; and determining whether the munition is to be fired based on the calculation.

9 Claims, 2 Drawing Sheets

U.S. PATENT DOCUMENTS

2006/0255690 A1* 11/2006 Rastegar et al. ..... 310/339
2007/0119326 A1* 5/2007 Rudakevych et al. ..... 102/206
2007/0204756 A1* 9/2007 Rastegar et al. ..... 102/210

* cited by examiner

ENERGY HARVESTING POWER SOURCES FOR ACCIDENTAL DROP DETECTION AND DIFFERENTIATION FROM FIRING

CROSS-REFERENCE TO RELATED APPLICATION

This application claims priority to earlier filed U.S. provisional application Ser. No. 60/759,606 filed on Jan. 17, 2006, the entire contents of which is incorporated herein by its reference. The electrical energy harvesting power sources disclosed herein are described in detail in U.S. patent application Ser. Nos. 10/235,997 and 11/116,093, each of which are incorporated herein by their reference.

GOVERNMENTAL RIGHTS

This invention was made with Government support under Contract No. DAAE30-03-C1077, awarded by the U.S. Army. The Government may have certain rights in this invention.

BACKGROUND OF THE INVENTION

1. Field of the Invention

The present invention relates generally to power supplies, and more particularly, to power supplies for projectiles, which generate power due to an acceleration of the projectile.

2. Prior Art

Fuzing of munitions is necessary to initiate a firing of the munition. Currently, there is no reliable and simple mechanism for differentiating an accidental drop of a munition from a firing acceleration, to prevent an accidental drop from initiating a fuzing of the munition. Similarly, there is a need to reliably validate firing and start of the flight of a munition. For rounds with booster rockets, this capability can provide the means to validate firing, firing duration and termination. Munitions further require the capability to detect target impact, to differentiate between hard and soft targets and to provide a time-out signal for unexploded rounds. Lastly, in order to recover unexploded rounds (munitions) it would be desirable for the munition to have the capability to notify a recovery crew.

SUMMARY OF THE INVENTION

The power sources/generators/supplies disclosed in U.S. patent application Ser. Nos. 10/235,997 and 11/116,093 are based on the use of piezoelectric elements. Such power sources are designed to harvest electrical energy from the firing acceleration as well as from the aerodynamics induced motions and vibration of the projectile during the entire flight. The energy harvesting power sources can withstand firing accelerations of over 100,000 Gs and can be designed to address the power requirements of various fuzes, communications gear, sensory devices and the like in munitions.

The electrical energy harvesting power sources are based on a novel approach, which stores mechanical energy from the short pulse firing accelerations, and generates power over significantly longer periods of time by vibrating elements, thereby increasing the amount of harvested energy by orders of magnitude over conventional methods of directly harvesting energy from the firing shock. With such power sources, electrical power is also generated during the entire flight utilizing the commonly present vibration disturbances of various kinds of sources, including the aerodynamics disturbances or spinning. Such power sources may also be used in a hybrid mode with other types of power sources such as chemical reserve batteries to satisfy any level of power requirements in munitions.

While the piezoelectric power generators are generally suitable for many applications, they are particularly well suited for low to medium power requirements, particularly when safety and very long shelf life are critical factors.

The electrical energy harvesting power sources for munitions are based on a novel use of stacked piezoelectric elements. Piezoelectric elements have long been used in accelerometers to measure acceleration and in force gages for measuring dynamic forces, particularly when they are impulsive (impact) type. In their stacked configuration, the piezoelectric elements have also been widely used as micro-actuators for high-speed and ultra-accuracy positioning applications with low voltage input requirement and for high-frequency vibration suppression. The piezoelectric elements have also been used as ultrasound sources and for the generation and suppression of acoustic signals and noise.

In the present application, the electrical energy harvesting power sources are used for powering fuzing electronics as acceleration and motion sensors, acoustic sensors, micro-actuation devices, etc., that could be used to enhance fusing safety and performance. As such, the developed electrical energy harvesting power sources, in addition to being capable of replacing or at least supplementing chemical batteries, have significant added benefits in rendering fuzing safer and enhancing its operational performance. Fir example, the piezoelectric-based electrical energy harvesting power sources can provide the following safety and performance enhancing capabilities:

1. Capability to detect accidental drops and differentiate them from the firing acceleration.
2. Capability to validate firing and start of the flight. For rounds with booster rockets, this capability will provide the means to validate firing, firing duration and termination.
3. Capability to detect target impact.
4. Capability to differentiate between hard and soft targets.
5. Capability to provide time-out signal for unexploded rounds.
6. In an unexploded round, the capability to detect acoustic and vibration wake-up signals generated by a recovery crew and respond to the same via an RF or acoustic signal or the like.

Accordingly, a system is provided for use with a munition for differentiating a non-firing event from a firing event. The system comprising: a power supply having a piezoelectric material for generating power from a vibration induced by the munition; a processor operatively connected to the power supply for monitoring an output from the power supply, calculating an impact pulse and determining whether the munition is to be fired based on the calculation The processor can compare the calculated impact pulse to a predetermined threshold value. In which case, the processor can output a signal to prevent initiation of fuzing where the calculated impact pulse is below the predetermined threshold value and/or the processor can output a signal to allow initiation of fuzing where the calculated impact pulse is above the predetermined threshold value.

Also provided is a method for differentiating a non-firing event of a munition from a firing event. The method comprising: providing the munition with a power supply having a piezoelectric material for generating power from a vibration induced by the munition; monitoring an output from the power supply; calculating an impact pulse from the output; and determining whether the munition is to be fired based on the calculation.

The determining can comprise comparing the calculated impact pulse to a predetermined threshold value. In which case the method can further comprise preventing initiation of fuzing where the calculated impact pulse is below the predetermined threshold value and/or allowing initiation of fuzing where the calculated impact pulse is above the predetermined threshold value.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

In the methods and apparatus disclosed herein, the spring end of a mass-spring unit is attached to a housing (support) unit via one or more piezoelectric elements, which are positioned between the spring end of the mass-spring and the housing unit. A housing is intended to mean a support structure, which partially or fully encloses the mass-spring and piezoelectric elements. On the other hand, a support unit may be positioned interior to the mass-spring and/or the piezoelectric elements or be a frame structure that is positioned interior and/or exterior to the mass-spring and/or piezoelectric elements. The assembly is provided with the means to preload the piezoelectric element in compression such that during the operation of the power generation unit, tensile stressing of the piezoelectric element is substantially avoided. The entire assembly is in turn attached to the base structure (e.g., gun-fired munitions). When used in applications that subject the power generation unit to relatively high acceleration/deceleration levels, the spring of the mass-spring unit is allowed to elongate and/or compress only within a specified limit. Once the applied acceleration/deceleration has substantially ended, the mass-spring unit begins to vibrate, thereby applying a cyclic force to the piezoelectric element, which in turn is used to generate electrical energy. The housing structure or the base structure or both may be used to provide the limitation in the maximum elongation and/or compression of the spring of the mass-spring unit (i.e., the amplitude of vibration). Each housing unit may be used to house more than one mass-spring unit, each via at least one piezoelectric element. In the following schematic the firing acceleration is considered to be upwards as indicated by arrow 113.

Figure 1:
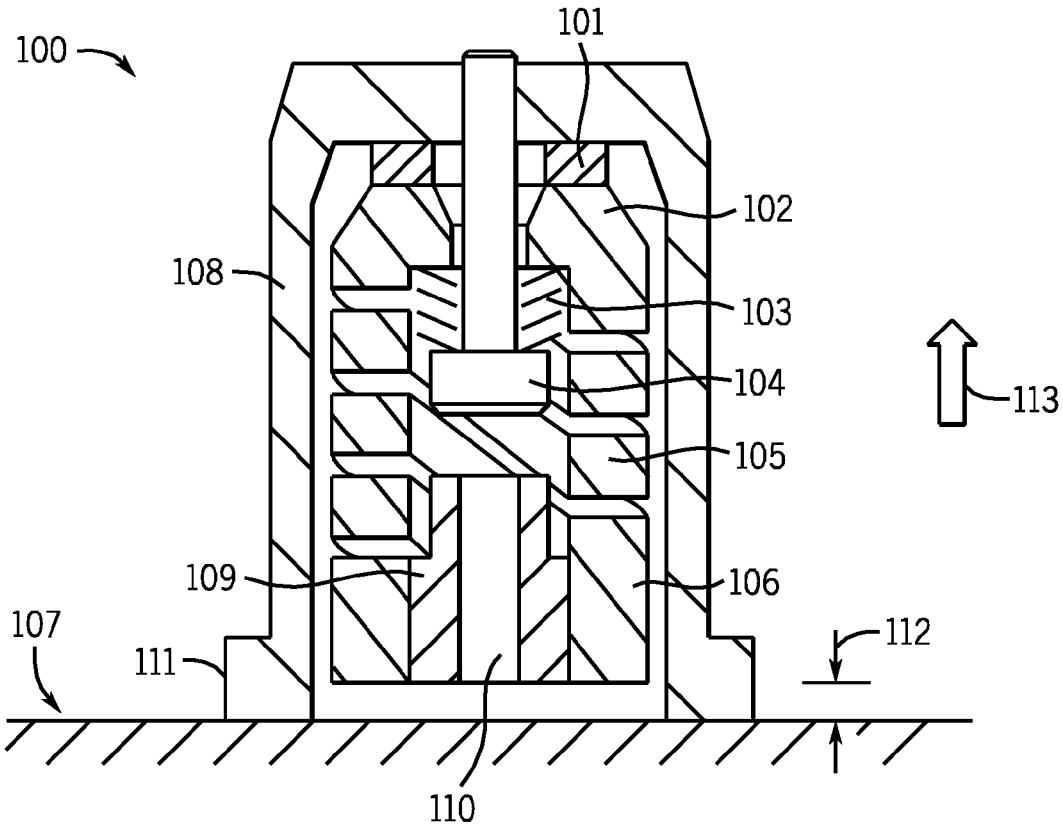
FIG. 1 illustrates a schematic cross section of an exemplary power generator for fuzing of a munition.

In FIG. 1, power generation unit 100 includes a spring 105, a mass 110, an outer shell 108, a piezoelectric (stacked and washer type) generator 101, one socket head cap screw 104 and a stack of Belleville washers 103 (each of the washers 103 in the stack is shown schematically as a single line). Piezoelectric materials are well known in the art. Furthermore, any configuration of one or more of such materials can be used in the power generator 100. Other fasteners, which may be fixed or removable, may be used and other means for applying a compressive or tensile load on the piezoelectric generator 101 may be used, such as a compression spring. The piezoelectric generator 101 is sandwiched between the outer shell 108 and an end 102 of the spring, and is held in compression by the Belleville washer stack 103 (i.e., preloaded in compression) and the socket head cap screw 104. The mass 109 is attached (e.g., screwed, bonded using adhesives, press fitted, etc.) to another end 106 of the spring 105. The piezoelectric element 101 is preferably supported by a relatively flat and rigid surface to achieve a relatively uniform distribution of force over the surface of the element. This might be aided by providing a very thin layer of hard epoxy or other similar type of adhesives on both contacting surfaces of the piezoelectric element. The housing 108 may be attached to the base 107 by the provided flange 111 using well known methods, or any other alternative method commonly used in the art such as screws or by threading the outer housing and screwing it to a tapped base hole, etc. The mass 109 is provided with an access hole 110 for tightening the screw 104 during assembly. Between the free end 106 of the spring and the base 107 (or if the mass 109 projects outside the end 106 of the spring, then between the mass 109 and the base 107) a gap 112 is provided to limit the maximum expansion of the spring 105. Alternatively, the gap 112 may be provided by the housing 108 itself. The gap 112 also limits the maximum amplitude of vibration of the mass-spring unit.

During firing of a projectile (the base structure 107) containing such power generation unit 100, the firing acceleration is considered to be in the direction 113. The firing acceleration acts on the mass 109 (and the mass of the spring 105), generating a force in a direction opposite to the direction of the acceleration that tends to elongate the spring 105 until the end 106 of the spring (or the mass 109 if it is protruding from the end 106 of the spring) closes the gap 112. For a given power generator 100, the amount of gap 112 defines the maximum spring extension, thereby the maximum (tensile) force applied to the piezoelectric element 101. As a result, the piezoelectric element is protected from being damaged by tensile loading. The gap 112 also defines the maximum level of firing acceleration that is going to be utilized by the power generation unit 100.

When the firing acceleration has ended, i.e., after the projectile has exited the gun barrel, the mechanical (potential) energy stored in the elongated spring is available for conversion into electrical energy. This can be accomplished by harvesting the varying voltage generated by the piezoelectric element 101 as the mass-spring element vibrates. The spring rate and the maximum allowed deflection determine the amount of mechanical energy that is stored in the spring 105. The effective mass and spring rate of the mass-spring unit determine the frequency (natural frequency) with which the mass-spring element vibrates. By increasing (decreasing) the mass or by decreasing (increasing) the spring rate of the mass-spring unit, the frequency of vibration is decreased (increased). In general, by increasing the frequency of vibration, the mechanical energy stored in the spring 105 can be harvested at a faster rate. Thus, by selecting appropriate spring 105, mass 109 and gap 112, the amount of electrical energy that can be generated and the rate of electrical energy generation can be matched with the requirements of a projectile.

In FIG. 1, the spring 105 is shown to be a helical spring. The preferred helical spring, however, has three or more equally spaced helical strands to minimize the sideways bending and twisting of the spring during vibration. In general, any other type of spring may be used as long as they provide for vibration in the direction of providing cyclic tensile-compressive loading of the piezoelectric element.

The power generation unit 100 of FIG. 1 is described herein by way of example only and not to limit the scope or spirit of the present invention. Other embodiments described in U.S. patent application Ser. Nos. 10/235,997 and 11/116,093 can also be used in the applications described below as well as any other type of power generation unit which harvests electrical energy from a vibrating mass due to the acceleration of a projectile/munition as well as from the aerodynamics induced motions and vibration of the projectile during the entire flight.

Figure 2:
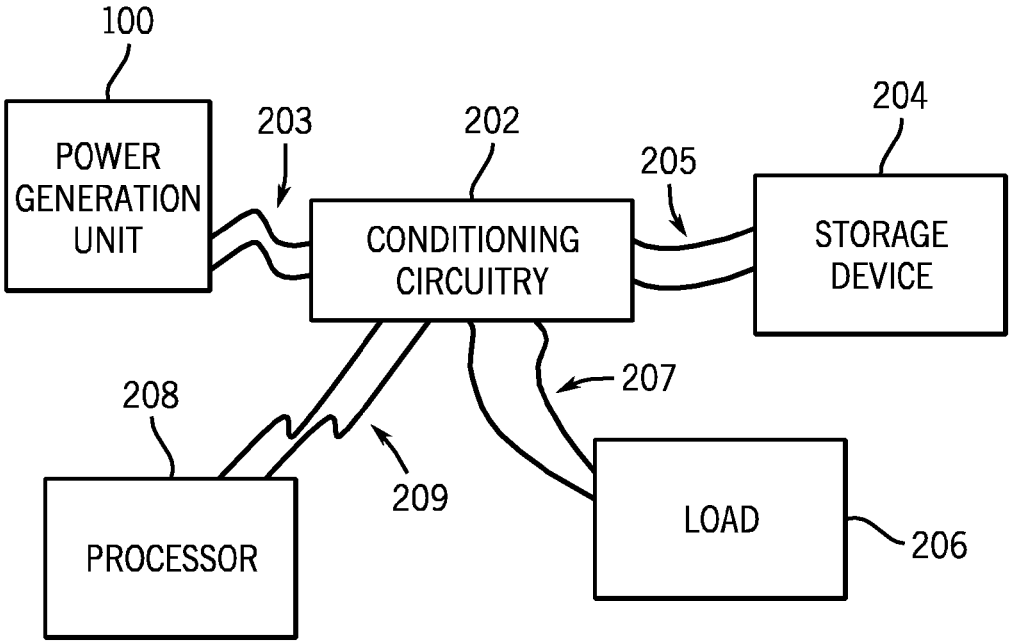
FIG. 2 illustrates a schematic view of a system of harvesting electric charges generated by the power generator of FIG. 1.

The schematic of FIG. 2 shows a typical system of harvesting electric charges generated by the piezoelectric element of the energy harvesting power generation unit 100 as the mass-spring element of the power source begins to vibrate upon exiting the gun barrel. Electronic conditioning circuitry 202, well known in the art, would, for example, convert the oscillatory (AC) voltages generated by the piezoelectric element to a DC voltage and then regulate it and provide it for direct use or for storage in a storage device 204 such as a capacitor or a rechargeable battery as shown in the schematic of FIG. 2. The piezoelectric output is connected by wires 203 to the electronic converter/regulator/charger 202, the output of which is connected to the storage device (a capacitor or rechargeable battery) 204 by wires 205, or is used to directly run a load 206 via wires 207. A processor 208 is also provided for processing information from the output of the power generation unit 100. Although the processor 208 is shown connected by way of wiring 209 to the electronic conditioning circuitry 202, it can be connected to or integral with any of the shown components such that it is operative to process the output or output information from the power generation unit 100.

Accidental Drop Detection and Differentiation from Firing

During the firing, the force exerted by the spring element of the power generation unit 100 generates a charge and thereby a voltage across the piezoelectric element that is proportional to the acceleration level being experienced. The generated voltage is proportional to the applied acceleration since the applied acceleration works on the mass of the spring-mass element of the energy harvesting power source (in fact the mass of the piezoelectric element itself as well), thereby generating a force proportional to the applied acceleration level.

In certain situations and particularly in the presence of noise and at relatively low acceleration levels, the mass-spring system of the power generation unit 100 begins to vibrate and generates an oscillatory (AC) voltage with a DC bias, which is still proportional to the level of acceleration that is applied to the munitions. Hereinafter, when vibratory motion is present, the piezoelectric voltage output is intended to indicate the level of the aforementioned DC bias.

Figure 3:
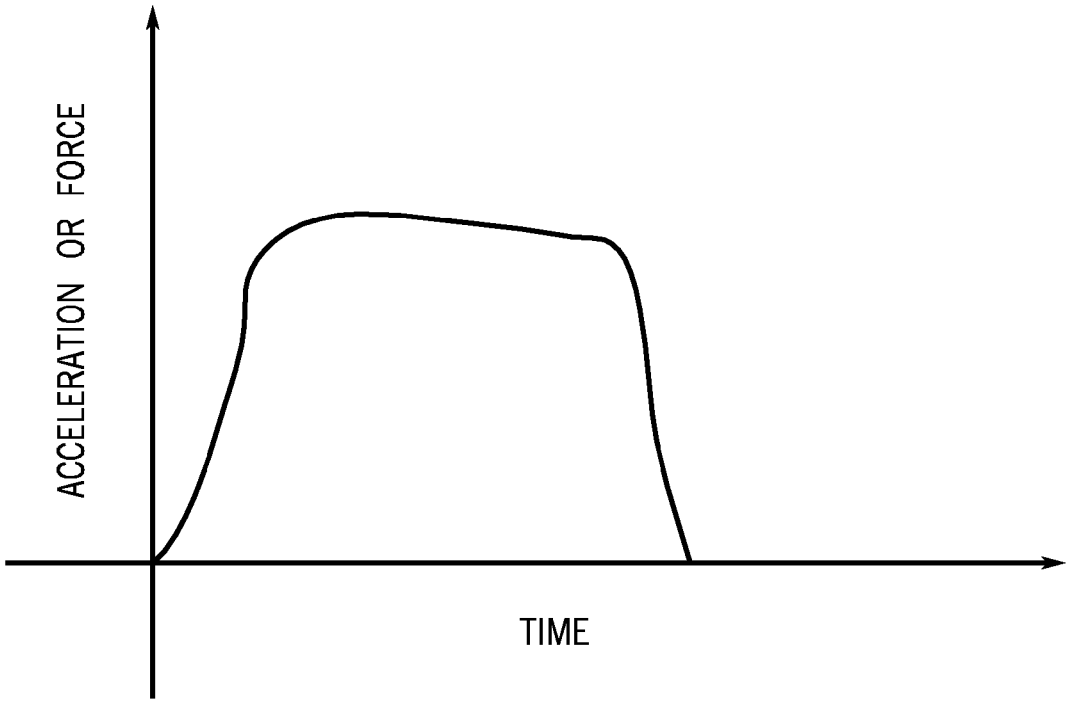
FIG. 3 illustrates a longitudinal acceleration (firing force, which is equal to the longitudinal acceleration times the mass of the round) versus time plot for a fired munition.

The level of voltage produced by the piezoelectric element is therefore proportional to the level of acceleration that is experienced by the munitions in the longitudinal (firing) direction. This information is obviously available as a function of time. A typical such longitudinal acceleration (firing force, which is equal to the longitudinal acceleration times the mass of the round) versus time plot may look as shown in FIG. 3. From this plot, the processor 208 may calculate information such as the peak acceleration (impulsive force) level and the acceleration (firing force) duration, $\Delta t$, can be measured. The processor 208 can be dedicated for such calculations or used for controlling other functions of the munition. The plot information can also be used to calculate the average acceleration (firing force) level and the total applied impulse (the area under the force versus time curve of FIG. 3 or the product of the average firing force times the time duration). The amount of impulse that the round is subjected to in its longitudinal (firing) direction is thereby known. In practice, the processor may be used onboard the munitions (or the generally present fuzing processor could be used) to make the above time and voltage (acceleration or firing force) measurements and perform the indicated calculations and provide the safety and fuzing decision making capabilities that are indicated in the remainder of this disclosure.

However, a round is subjected to such input impulses in its longitudinal direction during its firing as well as during accidental dropping. The level of input impulse due to accidental dropping of the round is, however, orders of magnitude smaller than that of firing.

For example, consider a situation in which a round is dropped on a very rigid concrete slab, generating around 15,000 G of acceleration in the longitudinal direction (here, it is assumed that the round is dropped perfectly on its base, resulting in the highest possible longitudinal impact acceleration). Assuming that the elastic deformation that occurs during the impact is in the order of 0.1 mm, a conservative estimate of the impact duration with a constant acceleration of 15,000 Gs becomes about 0.04 msec. Now, even if we assume a similar acceleration profile in the gun barrel, but spread it over a time duration of 8 msec (close to what is experienced in many large caliber guns), then the impulse experienced during the firing is (8/0.04) or 200 times larger than that experienced during a drop over a hard surface. This is obviously a conservative estimate and the actual ratio can be expected to be much higher since in most situations, the round is not expected to land perfectly on its base and on a very hard surface and that the firing acceleration is expected to be significantly larger than those experienced in an accidental drop.

The above example clearly shows that by measuring the impact impulse, accidental drops can be readily differentiated from the firing acceleration by the processor 208. This characteristic of the present piezoelectric based power generation units 100 can be readily used to construct a safety feature to prevent arming of the fuzing during accidental drops and/or to take some other preventive measures. This safety feature can be readily implemented in the electrical energy collection and regulation electronics of the power source or in the fuzing electronics (e.g., the processor 208 can have an input into the electrical energy collection and regulation electronics 202 of the power source or in the fuzing electronics to prevent fuzing when the calculated impact pulse is below a predetermined threshold value indicative of a firing).

Firing Validation and Booster firing and Duration Time and Total Impulse

As was described in the previous section on accidental drop detection and differentiation from firing, the firing impulse as well as its acceleration profile and time duration can be readily measured and/or calculated from the output of the piezoelectric elements of the power generation units 100 by the processor 208. Similarly, the completion of the firing acceleration cycle and the start of the free flight are readily indicated by the piezoelectric element. In the presence of firing boosters, their time of activation; the duration of booster operation, and the total exerted impulse on the round can also be determined by the processor 208 from the output of the power generation unit 100.

As a result, the piezoelectric based power generation units provide the means to validate firing; determine the beginning of the free flight; and when applicable, validate booster firing and its duration.

Target Impact Detection

During the flight, the munition/projectile is decelerated by aerodynamic drag. Projectiles are commonly designed to produce minimal drag. As a result, the deceleration in the axial direction is fairly low. In addition, there may also be components of vibratory motions present in the axial direction. Axially oriented piezoelectric based power generation units 100 can also be very insensitive to lateral accelerations, which are also usually fairly small except for high spinning rate projectiles.

When impact occurs (assuming that the impact force is at least partially directed in the axial direction), the piezoelectric elements of the power generation units 100 experience the resulting input impact, including the time of impact, the impact acceleration level, peak impact acceleration (force) and the total impact impulse. As a result, the exact moment of impact can be detected and/or calculated by the processor 208 from the output of the power generation unit 100.

In addition, when desired, lateral impact time, level and total impulse may be similarly detected by employing at least one such piezoelectric based power generation unit 100 in the lateral directions, noting that at least two piezoelectric power sources directed in two different directions in the lateral plane are required to provide full lateral impact information. Such laterally directed power sources are generally preferable for harvesting lateral vibration and movements, such as those generated by small yawing and pitching motions of the round.

Hard and Soft Target Detection

When the munition impacts the target, ground or another object, the munition's deceleration profile can be measured from the piezoelectric element output voltage during the impact period and peak deceleration level, impact duration, impact force and total impulse can then be calculated as previously described using the processor 208. This information can then be used to determine if a relatively hard or soft target has been hit, noting that the softer the impacted target, the longer would be the duration of impact, peak impact deceleration (force). The opposite will be true for harder impacted targets. This information is very important since it can be used by the fuzing system to make a decision as to the most effective settings.

It is worth noting at this point that the hard or soft target detection and decision making, in fact all the aforementioned detection and decision making processes, are expected to be made nearly instantly by the power source electrical energy collection and regulation electronics or the fuzing electronics by employing, for example, threshold detecting switches to set appropriate flags.

Time-out Signal for Unexploded Rounds

Once a munition has landed and is not detonated, whether due to faulty fuzing or other components or properly made decision against detonation, the piezoelectric based power generation unit 100 will stop generating electrical energy once its initial vibratory motion at the time of impact has died out. The electrical power harvesting electronics and/or the fuzing electronics can utilize this event, if followed by target impact, to initiate detonation time-out circuitry. For example, the power source and/or fuzing electronics can be equipped with a time-out circuit that would disable the detonation circuitry and/or components to make it impossible for the round to be internally detonated. The time-out period can be programmed, for example, while loading fuzing information before firing, and/or may be provided by built-in leakage rate from capacitors assigned for this purpose.

Wake-Up Signal Detection and Detection Beacon Provision

Consider the situation in which a round has landed without detonation and its detonation window has timed-out. Then at some point in time, a recovery crew may want to attempt to safely recover the unexploded rounds. The present piezoelectric based power generation unit 100 can readily be used to transmit an RF or other similar beacon signals for the recovery crew to use to locate the projectile. This may, for example, be readily accomplished through the generation of acoustic signals that are produced by the dropping or hammering of weights on the ground or by detonating small charges in the suspect areas. The acoustic waves will then cause the piezoelectric elements of the power source to generate a small amount of power to initiate wake-up and transmission of the RF or similar beacon signal.

When appropriate, the acoustic signal being transmitted by the recovery crew could be coded. In addition, this feature of the power generation unit 100 provides the means for the implementation of a variety of tactical detonation scenarios. As an example, multiple rounds could be fired into an area without triggering detonation, awaiting a detonation signal from a later round, which is transmitted by a coded acoustic signal during its own detonation.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A system for use with a munition for differentiating a non-firing event from a firing event, the system comprising:

a power supply having a piezoelectric material for generating power from a vibration induced by the munition; and a processor operatively connected to the power supply for monitoring an output from the power supply, calculating an impact pulse and determining whether the munition is to be fired based on the calculation.

2. The system of claim 1, wherein the processor compares the calculated impact pulse to a predetermined threshold value.

3. The system of claim 1, wherein the processor outputs a signal to prevent initiation of fuzing where the calculated impact pulse is below the predetermined threshold value.

4. The system of claim 1, wherein the processor outputs a signal to allow initiation of fuzing where the calculated impact pulse is above the predetermined threshold value.

5. A method for differentiating a non-firing event of a munition from a firing event, the method comprising:

providing the munition with a power supply having a piezoelectric material for generating power from a vibration induced by the munition;

monitoring an output from the power supply;

calculating an impact pulse from the output; and determining whether the munition is to be fired based on the calculation.

6. The method of claim 5, wherein the determining comprises comparing the calculated impact pulse to a predetermined threshold value.

7. The method of claim 6, further comprising preventing initiation of fuzing where the calculated impact pulse is below the predetermined threshold value.

8. The method of claim 6, further comprising allowing initiation of fuzing where the calculated impact pulse is above the predetermined threshold value.

9. The system of claim 1, wherein the power supply comprises:

a mass; and a spring element connected at one end to the mass and at another end to the piezoelectric material.

* * * * *